US005137067A

United States Patent [19]

Espeut

[11] Patent Number: 5,137,067

[45] Date of Patent: Aug. 11, 1992

[54] HYDROPHILIC AND CORROSION RESISTANT FINS FOR A HEAT EXCHANGER

[75] Inventor: Kenneth W. Espeut, Tampa, Fla.

[73] Assignee: JW Aluminum Company, Tampa, Fla.

[21] Appl. No.: 808,139

[22] Filed: Dec. 16, 1991

[51] Int. Cl.[5] ..... F28F 13/18; F28F 19/02

[52] U.S. Cl. ..... 165/133; 165/134.1; 428/463

[58] Field of Search ..... 165/133, 134.1; 428/463, 472.2, 522

[56] References Cited

U.S. PATENT DOCUMENTS

| | | | |
|---|---|---|---|
| 3,929,741 | 12/1930 | Laskey | 260/79.3 |
| 4,181,773 | 1/1980 | Rickert, Jr. | 428/329 |
| 4,588,025 | 5/1986 | Imai et al. | 165/133 |
| 4,664,182 | 5/1987 | Miwa | 165/133 |
| 4,718,482 | 1/1988 | Iwama et al. | 165/133 |
| 4,726,886 | 2/1988 | Kaneko et al. | 204/37.6 |
| 4,830,101 | 5/1989 | Ohara et al. | 165/133 |
| 5,009,962 | 4/1991 | Yamasoe | 428/470 |
| 5,012,862 | 5/1991 | Espeut et al. | 165/133 |

FOREIGN PATENT DOCUMENTS

| | | | |
|---|---|---|---|
| 82643 | 12/1987 | Australia . | |
| 54-159759 | 12/1979 | Japan | 165/133 |
| 61-185570 | 8/1986 | Japan | 165/133 |
| 62-172196 | 7/1987 | Japan | 165/133 |

*Primary Examiner*—Allen J. Flanigan
*Attorney, Agent, or Firm*—James W. Grace

[57] ABSTRACT

A fin for a heat exchanger is coated with a hydrophilic and corrosion resistant coating formed by applying an aqueous solution consisting essentially of a plasticized vinyl chloride polymer, an aqueous dispersion of a high molecular weight resin, and interfacial tension modifier, a hexamethoxymethyl melamine resin, and ester alcohol coalescing aid, and water.

4 Claims, No Drawings

HYDROPHILIC AND CORROSION RESISTANT FINS FOR A HEAT EXCHANGER

BACKGROUND OF THE INVENTION

This invention relates to fins for a heat exchanger which have been treated to be hydrophilic and corrosion resistant.

Heat exchangers of various types have been used in a wide range of applications including room air conditioners, car air conditioners and air conditioners incorporating space coolers and heaters, for example. These heat exchangers are made preponderantly of aluminum and aluminum alloys. They generally comprise a zigzagging copper tube for carrying a coolant, refrigerant or the like and a multiplicity of fins disposed substantially in parallel to one another around the tube.

To reduce the size and improve performance, the designs for heat exchangers of this class of late have employed increasing numbers of fins and, therefore, have had an ever increasing available area of contact between the incoming air and the fins. For the same reasons, the space separating the fins is being reduced to the greatest extent possible without increasing the resistance to air flow between the fins.

When the surface temperature of the fins and the coolant tube falls below the dew point while the cooler is in operation, dew adheres to the surfaces of the fins and coolant tube. The dew adhering to the fins collects into hemispheres or spheres, which may grow until they reach the adjacent fins. When the dew reaches to the adjacent fins in this fashion, it can continue to collect by capillary action, clogging the spaces between the fins. This phenomenon is called bridging.

When the dew induces this bridging phenomenon, the resistance offered by the fins to the passing current of air increases notably, the heat-exchange ratio consequently is lowered and the cooling capacity of the heat exchanger degraded. These fins, therefore, should possess a hydrophilic surface.

The methods proposed to date for imparting a hydrophilic surface to the fins include forming thereon a coating containing a surfactant such as polyoxyethylene nonylphenyl ether on the surfaces of the fins, coating the surfaces of the fins with colloidal silica or water glass, and subjecting the surfaces of the fins to a post boehmite-treatment, for example.

Another hydrophilic coating comprises a proteinaceous substance having a peptide bond, i.e., gelatin. Further enhancement of the fins affinity for water is obtained by using a hydrophilic coat prepared by mixing a water soluble coating material such as acrylic paint, with the proteinaceous substance.

Other methods for coating fins may involve a phosphate treated aluminum surface which is processed directly with an aqueous silicate coating and then dried.

A still further method is coating an aluminum fin with an organic resin film having corrosion resistance over which a hydrophilic coating consisting of silicates such as silica sol, silicic acid and water glass is formed In addition to the problem of providing hydrophilicity for the fins, corrosion between the copper tubes which carry the cooling agent and the aluminum fins present a further problem.

SUMMARY OF THE INVENTION

An object of this invention is to provide fins for a heat exchanger which have a high affinity for water and therefore inhibit the aforementioned bridging phenomenon due to dew.

Another object of this invention is to provide fins which are highly machinable during fabrication (by pressing, punching, etc.).

A still further object of this invention is to provide a medium to inhibit or prevent corrosion between the copper tubing and the aluminum fins as well as corrosion of the aluminum fins themselves.

These objectives are accomplished according to the present invention by providing a fin having a hydrophilic coating containing a specific substance on the surfaces of fin substrates, preferably made of aluminum or an aluminum alloy. To be specific, the fins of a heat exchanger according to the present invention have formed on their surfaces a hydrophilic and corrosion resisting coating comprising a plasticized vinyl chloride copolymer, an aqueous dispersion of a high molecular weight resin, an interfacial tension modifier, a hexamethoxymethyl melamine resin, an ester alcohol coalescing aid, an aqueous pigment dispersant and water.

The other objects and characteristic features of the present invention will become apparent to those skilled in the art from the following description of a preferred embodiment of the invention.

DETAILED DESCRIPTION OF THE INVENTION

The fin itself is preferably of thin aluminum stock (about 0.1 to 0.3 mm in thickness). After a well-known cleaning process, the fin is coated with an aqueous coating of a hydrophilic and corrosion resistant coating which is left to dry.

The preferred formula for the hydrophilic and corrosion resistant coating of the invention is:

| | Preferred P.b.w. | Range P.b.w. |
|---|---|---|
| Vinyl chloride copolymer | 37 | 35–39 |
| High molecular epoxy weight resin | 24.40 | 23–26 |
| Interfacial tension modifier | 0.25 | 0.125–0.375 |
| Hexamethoxymethyl melamine resin | 1.92 | 0.96–2.90 |
| Ester alcohol | 5.00 | 2.5–7.5 |
| Pigment dispersant | 10.00 | 5–15 |
| Water | 21.43 | 10.7–32 |
| | 100% | |

The preferred vinyl chloride copolymer is a polyblend of vinyl chloride latex and nitrile rubber latex, sold under the trademark GEON 552 by B. F. Goodrich Company, of Cleveland, Ohio.

The preferred high molecular weight epoxy resin is an aqueous dispersion of a modified high molecular weight epoxy resin designed to crosslink with melamine or urea formaldehyde resins sold under the designation RGX 87819 by Rhone-Poulence, a French company of Louisville, Kentucky.

The preferred interfacial tension modifier is a siliconefree blend of 2-butoxyethanol and water sold by Daniel Products Company of Jersey City, New Jersey under the trademark DAPRO W-77. The modifier is a compound which can reduce interfacial tension by forming an absorption layer of intermediate surface tension between liquid/liquid or liquid/ solid phases.

The preferred hexamethylmethoxy melamine resin is a versatile crosslinking agent for a wide range of polymeric materials sold under the trademark CYMEL 303 by American Cyanamid Company of Wayne, New Jersey.

The preferred ester alcohol is an ester alcohol sold under the trademark TEXANOL by Eastman Chemicals Company of Kingsport, Tennessee.

The preferred pigment dispersant may be either a conductive black dispersion or blue dispersion which is conventionally used in water solutions to determine the color of the water solution.

While the specific chemical components have been designated by trademarks for specific companies, the equivalent chemical components can be purchased by those skilled in the art from other chemical suppliers under the common chemical designations or alternative trademarks.

In order to show the effectiveness of the hydrophilic and corrosion resistant coating, a series of contact angle tests were made to determine affinity for water. In the contact angle test, a drop of distilled water was placed on each test piece with a pipette and the contact angle of the drop as observed under a microscope.

The pieces of fin stock used in the tests were about 0.005 inches in thickness and squares of 3"×3" in area. The surface of one side of each piece of fin stock was watered with the preferred formula at a rate of about 1.7 pounds per 3000 square feet. A range of between 1.5 and 1.7 pounds per square feet of the preferred formula is suitable.

The initial contact angle was determined by using a freshly watered but dried sheet of fin stock and by applying a single drop of water from a pipette gently on the surface. The contact angle was measured to be between 10° and 15° .

A cycling test was then performed using three pieces of fin stock which were coated and dried. Each piece of fin stock was immersed in running water for seven hours. The rate of the water was at about 700-1000 ml per minute. After seven hours, the sheets were dried at 220° F. (about 104° C.) for about 17 hours.

The contact angle was measured after 30 cycles and found to be between 55 and 65 degrees.

With respect to the anti-corrosion properties of the preferred formulation, the combined copper tubing and fin stock were tested by a salt spray for 500 hours according to the test procedure of ASTM B117.

Thus, the aluminum fin stock with an aqueous solution of a hydrophilic and corrosion resistant coating resulted in a wettable fin stock which avoids the problems of bridging and corrosion. While a specific embodiment of the invention has been described, other variations will occur to those skilled in the art and it is intended to cover this embodiment and other variations in the accompanying claims.

I claim:

1. An aluminum fin stock comprising a thin sheet of aluminum, said sheet having one or more sides coated with an aqueous solution consisting essentially of a plasticized vinyl chloride copolymer, an aqueous dispersion of a high molecular weight resin, an interfacial tension modifier, a hexamethoxymethyl melamine resin, an ester alcohol coalescing aid, and water.

2. An aluminum fin stock as recited in claim 1 in which said solution also includes an aqueous pigment dispersant.

3. An aluminum fin stock as recited in claim 1 in which said solution is applied at an amount of between 1.5 and 1.7 pounds per 3000 square feet.

4. An aluminum fin stock as recited in claim 1 in which said solution comprises between 35 and 39 parts by weight of a vinyl chloride copolymer, between 23 and 26 parts by weight of high molecular epoxy weight resin, between 0.125 and 0.375 parts by weight of interfacial tension modifier, between 0.96 and 2.90 parts by weight of hexamethoxymethyl melamine resin, between 2.5 and 7.5 parts by weight of ester alcohol, between 5 and 15 parts by weight of pigment dispersant, and between 10.7 and 32 parts by weight of water.

* * * * *